US006318139B1

(12) United States Patent
Ishikura et al.

(10) Patent No.: US 6,318,139 B1
(45) Date of Patent: Nov. 20, 2001

(54) WATERBORNE LUBRICANT FOR THE COLD PLASTIC WORKING OF METALS

(75) Inventors: Kazuhiro Ishikura, Kanagawa-Ken; Kazutomo Miyafuji, Okayama-Ken; Kenji Karube, Kanagawa-Ken, all of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/254,090

(22) PCT Filed: Aug. 29, 1997

(86) PCT No.: PCT/US97/14824

§ 371 Date: Mar. 1, 1999

§ 102(e) Date: Mar. 1, 1999

(87) PCT Pub. No.: WO98/08922

PCT Pub. Date: Mar. 5, 1998

(30) Foreign Application Priority Data

Aug. 29, 1996 (JP) ..... H8-247093

(51) Int. Cl.[7] ..... B21D 37/18
(52) U.S. Cl. ..... 72/42
(58) Field of Search ..... 72/42; 508/433

(56) References Cited

U.S. PATENT DOCUMENTS

| | | | | |
|---|---|---|---|---|
| 2,948,598 | * | 8/1960 | Brehm | 508/433 |
| 4,359,393 | | 11/1982 | Sturwold | 252/34.7 |
| 4,401,579 | * | 8/1983 | Kratzer | 72/42 |
| 4,419,253 | * | 12/1983 | Kennedy et al. | 508/433 |
| 4,765,917 | * | 8/1988 | Otaki et al. | 508/433 |

FOREIGN PATENT DOCUMENTS

| | | | | |
|---|---|---|---|---|
| 1594502 | | 5/1970 | (DE) . | |
| 4229848 | | 3/1994 | (DE) . | |
| 0591771 | | 4/1994 | (EP) . | |
| 2003923 | | 3/1979 | (GB) . | |
| WO 92/21737 | * | 12/1992 | (WO) | 72/42 |

* cited by examiner

*Primary Examiner*—Lowell A. Larson
(74) *Attorney, Agent, or Firm*—Wayne C. Jaeschke; Stephen D. Harper; Garrett V. Davis

(57) ABSTRACT

A waterborne lubricant for the cold plastic working of metals that contains alkali metal salts of dimer(s) and/or trimer(s) of unsaturated fatty acids with from 10 to 24 carbon atoms per molecule has a lubrication performance at least as good as that of prior lubricants, even at generally lower lubricating film weights, has a long bath life, and generates little dust during cold plastic working operations. Even as little as 5% of these salts of dimer(s) and/or trimer(s) of unsaturated fatty acids, when mixed with conventional alkali metal salts of saturated fatty acids with from 10–24 carbon atoms per molecule, can provide these benefits.

24 Claims, No Drawings

WATERBORNE LUBRICANT FOR THE COLD PLASTIC WORKING OF METALS

FIELD OF THE INVENTION

This invention relates to a waterborne lubricant for the cold plastic working of metals (referred to below simply as the waterborne lubricant) that can be used in the cold plastic working (e.g., forging, tube drawing, wire drawing, and the like) of metals such as carbon steel, stainless steel, high-alloy steel, and the like.

DESCRIPTION OF THE RELATED ART

A lubricant is typically used in the cold plastic working of metals, and a variety of lubricants are used for this purpose. As a general rule, the lubricant becomes sandwiched between the tool and workpiece and functions to reduce the friction coefficient and to extend tool life by preventing metal-to-metal contact.

Conversion coatings are used in one approach to the application of the lubricating film to the workpiece. It is known that very good working results can be obtained when the lubricant is applied to the workpiece subsequent to the execution of a conversion coating treatment on the workpiece. This methodology makes possible working at high working ratios and also improves tool durability (see Kinzoku Hyomen Gijutsu Benran [Title in English: *Handbook of Metal Finishing Technology*], page 719 (1987), edited by Kinzoku Hyomen Gijutsu Kyokai [Title in English: Metal Finishing Society of Japan], published by Nikkan Kogyo Shinbunsha). In a broad sense the lubricant can be said to include the conversion coating, but in fact the conversion coating as initially applied does not have a lubrication-improving activity. As a result it is used in combination with a fluid lubricant, of which typical examples are lubricating oils and waterborne lubricants, or with a solid lubricant such as molybdenum disulfide or a metal soap. As a consequence, the conversion coating is in some cases regarded in a narrow sense as a pretreatment (Tekko Shinsen yo no Junkatsuzai Manyuaru, Kaiteiban [Title in English: *Revised Lubricant Manual for Drawing Iron and Steel Wire*], page 18 (1994), edited by the Lubricant Working Group of the Wire Drawing Technology Section of Nippon Sosei Kako Gakkai [Japan Society for Technology of Plasticity]).

The conversion coating itself will vary as a function of the material of the workpiece. For example, in the case of carbon steels a phosphate coating (components=zinc phosphate, iron zinc phosphate, calcium zinc phosphate) is usually executed on the workpiece by dipping in an acidic aqueous solution containing phosphoric acid, nitric acid, zinc, and sometimes calcium. With stainless steels and high-alloy steels, an oxalate coating (main component=iron oxalate) is usually executed on the workpiece, using an acidic aqueous solution whose main component is oxalic acid. In the overall process of forming the lubricating film for cold plastic working, these conversion treatments are normally carried out after pickling with a prescribed concentration of hydrochloric acid or sulfuric acid to remove annealing scale and after a post-pickling water rinse.

Production of the lubricating film by dipping the conversion-coated workpiece in an aqueous solution whose main component is the alkali metal salt of a higher fatty acid (for example, sodium stearate) is generally known as "reactive soap treatment" (cf. Tekko Shinsen yo no Junkatsuzai Manyuaru, Kaiteiban, page 26).

Reactive soap treatment was first disclosed in German Patent Number 673,405 and subsequent thereto has gone on to become very widely used in wire drawing, tube drawing, and forging for the production of lubricating films for cold plastic working.

In reactive soap treatment, the conversion-coated workpiece is dipped in a treatment bath consisting mainly of the aqueous solution of an alkali metal salt of a monomeric higher fatty acid, a so-called "soap". The phosphate coating dissolves into the aqueous soap solution, and the metal component of the phosphate and the fatty acid participate in a metathesis reaction that produces a divalent metal (e.g., zinc or calcium) soap. This divalent metal soap, being insoluble in the aqueous alkali metal soap solution, precipitates onto the surface of the phosphate coating to generate a lubricating film. The reaction equation for the reaction of zinc phosphate with sodium stearate to produce a divalent metal soap are provided below by way of example:

$$Zn_3(PO4)_2 \cdot 4H_2O + 6NaC_{17}H_{35}COO \rightarrow 3Zn(C_{17}H_{35}COO)_2 + 2Na_3PO_4 + 4H_2O$$

Treatment bath is also taken up by the workpiece as it is withdrawn from the treatment bath, and as a result reactive soap coatings are believed to be composed of the following three layers considered in sequence from the metal surface: the phosphate coating, a divalent metal, water-insoluble soap layer, and a water-soluble soap layer.

While the main component in a reactive soap treatment bath is a so-called soap, that is, the alkali metal salt of a monomeric fatty acid such as sodium stearate, a buffer and rust preventive are ordinarily also added to the bath (James, Sheet Material Industries (3) (1961)). This reference also notes that the acidity or alkalinity of the reactive soap bath governs the reactivity.

The English-language abstract for German Patent Application Number 256,804 describes a lubricant for the cold plastic working of metals that comprises an insoluble but water-dispersible soap, inorganic additive, polyvinyl alcohol, and surfactant. In this lubricant the polyvinyl alcohol is derivatized by 0.2 to 3% modification with oxidant, and the lubricant composition contains a keto, carboxyl, and/or carboxylate modified salt.

The English-language abstract for Russian Patent Application SU 279,841 describes a lubricant for the cold plastic working of metals that comprises alkali metal soap which is 25 to 50% oleic acid, 15 to 20% linoleic acid, and 5 to 10% dihydroxystearic acid, and the lubricant also contains some triglycerides and other esters of these acids.

As a countermeasure to the lubricating layer exfoliation that can occur during cold working, Japanese Patent Application Laid Open [Kokai or Unexamined] Number Sho 57-40200 [40,200/1982] teaches the addition of an aqueous borax solution or a lime soap solution to a 2 to 5% emulsion of ethylene/vinyl acetate copolymer. The lime soap solution used here comprises quicklime, metal soap, aluminum stearate, and water.

Japanese Patent Application Laid Open [Kokai or Unexamined] Number Hei 5-156279 [156,279/1993] teaches a waterborne lubricant (reactive soap) for the plastic working of metals that characteristically contains (a) alkali metal salt of $C_8$ to $C_{22}$ saturated fatty acid and (b) alkali metal salt of $C_8$ to $C_{22}$ unsaturated fatty acid, wherein the quantity of the alkali metal salt of unsaturated fatty acid (b) is from 5 to 25 weight % of (a)+(b). The use of this lubricant reportedly results in low dust generation during the working operation as well as little lubricant adhesion to the tool.

While the above-described reactive soaps do have good lubricating characteristics, bath life is a characteristic problem with lubricants of this type (Tekko Shinsen yo no Junkatsuzai Manyuanu, Kaiteiban, page 27). Since reactive soap treatment produces a lubricating film through dissolution of the phosphate film, the components in the conversion coating, such as zinc, iron, and phosphoric acid, are thought to accumulate in the treatment bath with a concomitant decline in lubrication performance.

In actual line operations, the aged treatment bath is discarded and replaced with fresh bath when defective lubrication attributable to reactive soap bath life is detected. Since reactive soap treatment baths are ordinarily treated as industrial wastes, extending the bath life is not simply a cost issue, but is also an important issue for environmental protection.

Moreover, the dimensional accuracy of the worked products has undergone continual improvement in recent years, which has made reducing dust generation during working operations a much more important issue than in the past. For example, the dust produced by lubricating film exfoliation during forging can adhere to the tool, and this can prevent the workpiece from being finished to the specified dimensions, producing a defect known as "short thickness" or "missing thickness". Dust generation also pollutes the work site and degrades the environment, which again creates demand for a reactive soap that generates less dust.

The already cited Japanese Patent Application Laid Open Number Hei 5-156279 and Japanese Patent Application Laid Open Number Sho 57-40200 both disclose methods that counter dust generation during cold plastic working, but each is also entirely silent with regard to a reactive soap with an excellent bath life.

PROBLEMS TO BE SOLVED BY THE INVENTION

The object of the present invention is to provide a waterborne lubricant for the cold plastic working of metals that has a lubrication performance at least as good as prior lubricants, but which also has a long bath life and generates little dust during cold plastic working operations.

SUMMARY OF THE INVENTION

It has been discovered that the problems described above for the prior art can be overcome by specifying a type of reactive soap whose reactivity with conversion films is inhibited as much as possible while at the same time it still provides a lubricating performance at least as good as that of prior reactive soaps.

In more specific terms, the present invention relates to:

(1) waterborne lubricants for the cold plastic working of metals that characteristically comprise, preferably consist essentially of, or more preferably consist of, water and (A) alkali metal salt(s) of dimer(s) and/or trimer(s) of $C_{10}$ to $C_{24}$ unsaturated fatty acid(s) having at least one double bond;

(2) waterborne lubricants as described in (1), in which more than 0 weight % but no more than 95 weight % of the said alkali metal salt(s) of dimer(s) and/or trimer(s) of acid(s) (A) has been replaced by (B) alkali metal salt of $C_{10}$ to $C_{24}$ saturated fatty acid;

(3) waterborne lubricants as described in (1) or (2), that also contain a rust-preventive agent that is not part of alkali metal salt types (A) or (B) as described above; and/or (4) waterborne lubricants as described in (1) that also contain a buffer that is not an alkali metal salt of type (A) as described above; waterborne lubricants as described in (2) that also contain a buffer that is not an alkali metal salt of type (A) or of type (B) as described above; and waterborne lubricants as described in (3) that also contain a buffer that is not an alkali metal salt of type (A) or of type (B) as described above or a rust-preventive agent.

In this description, "dimer" denotes an acid with at least two carboxyl groups per molecule afforded by vinylic addition oligomerization of two molecules of at least one unsaturated aliphatic monocarboxylic acid such as an unsaturated fatty acid containing a carbon-carbon double bond. "Trimer" similarly refers to an acid with at least three carboxyl groups afforded by the oligomerization of three such molecules.

DETAILED DESCRIPTION OF THE INVENTION AND OF PREFERRED EMBODIMENTS

The alkali metal salt component (A) is preferably constituted of alkali metal salt(s) of dimer(s) and/or trimer(s) of one or more $C_{10}$ to $C_{24}$ and particularly $C_{16}$ to $C_{20}$ monounsaturated fatty acid(s); independently, the said alkali metal salt component (B) is preferably constituted of alkali metal salt(s) of one or more $C_{16}$ to $C_{20}$ saturated fatty acid(s); and independently the concentration of alkali metal salt (A)+ alkali metal salt (B) is preferably at least, with increasing preference in the order given, 5, 7, 8.0, 8.5, 9.0, 9.5, or 9.9 weight % of the total waterborne lubricant and independently preferably, primarily for reasons of economy, is not more than, with increasing preference in the order given, 40, 35, 30, 25, 20, 17, 14.0, 13.0, 12.0, 11.5, 11.0, 10.5 or 10.1 weight % of the total waterborne lubricant.

A monomeric unsaturated fatty acid molecule that is to be oligomerized to provide an anion for component (A) as described above must contain at least one double bond and preferably contains not more than four double bonds, more preferably not more than three double bonds, and most preferably exactly one double bond. This unsaturated fatty acid molecule must contain from 10 to 24 carbon atoms, but preferably contains 16 to 20 carbon atoms and most preferably contains 18 carbon atoms. The lubricating performance is poor at fewer than 10 carbons, while exceeding 24 carbons provides no additional improvement in lubricating performance while at the same time leading to increased amounts of dust. Furthermore and independently, a monomeric unsaturated fatty acid molecule that is to be oligomerized to provide an anion for component (A) as described above preferably contains only one carboxyl group.

Suitable $C_{10}$ to $C_{24}$ monounsaturated fatty acids are specifically exemplified by decenoic acids (e.g., obtusilic acid), dodecenoic acids (e.g., linderic acid, lauroleic acid), tetradecenoic acids (e.g., tsuzuic acid, physeteric acid, and myristoleic acid), hexadecenoic acids (e.g., gaidic acid, palmitoleic acid), octadecenoic acids (e.g., oleic acid, elaidic acid, vaccenic acid, petroselinic acid), eicosenoic acids (e.g., gadoleic acid, gadelaidic acid), docosenoic acids (e.g., erucic acid, brassidic acid, cetoleic acid), and tetracosenoic acids (e.g., nervonic acid). Suitable $C_{10}$ to $C_{24}$ polyunsaturated fatty acids are specifically exemplified by linoleic acid, linolenic acid, and arachidonic acid.

The most preferred dimers and trimers among the aforesaid $C_{10}$ to $C_{24}$ mono- and polyunsaturated fatty acids are the dimers and trimers, particularly the trimers, of $C_{18}$ unsaturated fatty acids, most preferably oleic acid.

The alkali metal in the subject alkali metal salt(s) of dimeric and/or trimeric acid(s) (A) is exemplified by sodium, potassium, and lithium, with sodium being preferred.

In the case of the dimeric acids, the alkali metal salt can be the monoalkali metal salt or dialkali metal salt, with the dialkali metal salt being preferred. In the case of the trimeric acids, the alkali metal salt can be the monoalkali metal salt, the dialkali metal salt, or the trialkali metal salt, with the trialkali metal salt being preferred.

The present invention can use a single selection or a freely selected combination from the subject alkali metal salts of dimeric and trimeric acids that provide the anions of component (A).

A portion of the alkali metal salt of dimeric or trimeric acid (A), i.e., more than 0 weight % but no more than 95 weight % and preferably no more than 90 weight %, can be replaced by the (B) alkali metal salt of $C_{10}$ to $C_{24}$, preferably $C_{16}$ to $C_{20}$, and particularly preferably $C_{18}$ saturated fatty acid. In other words, the desired object can be achieved even making this substitution. The benefit of the present invention from the presence of the said alkali metal salt(s) of dimeric and/or trimer acid(s) (A) essentially can not be achieved when the replacement rate with (B) exceeds 95 weight %. The lubricating performance will be unacceptable at fewer than 10 carbons, while exceeding 24 carbons results in an unsatisfactory inhibition of dust generation. Furthermore and independently, a saturated fatty acid molecule that is to provide an anion for component (B) as described above preferably contains only one carboxyl group.

The subject $C_{10}$ to $C_{24}$ saturated fatty acids are specifically exemplified by capric acid, lauric acid, myristic acid, palmitic acid, stearic acid, arachidic acid, behenic acid, and lignoceric acid. The alkali metal in alkali metal salt component (B) is exemplified by sodium, potassium, and lithium, with sodium being preferred. Sodium stearate is the most preferred constituent for component (B).

The present invention can use a single selection or a freely selected combination from the subject alkali metal salt(s) of saturated fatty acid(s) component (B).

The concentration of the alkali metal salt(s) of dimeric and/or trimeric acid(s) (A) plus alkali metal salt of saturated fatty acid (B) in the waterborne lubricant according to the present invention for the cold plastic working of metal is preferably 5 to 40 weight % as A+B and more preferably 5 to 20 weight % as A+B. Little desired effect is obtained at below 5 weight %, while values in excess of 40 weight % provide no additional improvement in lubricating performance to compensate for their necessarily higher cost.

When the workpiece coated with the waterborne lubricant according to the present invention is, for example, carbon steel, rust may be produced on the surface of the workpiece after it has been treated with the waterborne lubricant and dried. Rust generation runs the risk of impairing the appearance of the workpiece and reducing the performance of the lubricating film. In such cases the addition of a rust-preventive agent is therefore indicated. This rust-preventive agent can take the form of the rust preventives (often alternatively called "additives") heretofore used with reactive soap treatment baths. Optimal rust-preventive agents are exemplified by nitrite salts (sodium nitrite and the like), tungstate salts (sodium tungstate and the like), molybdate salts (sodium molybdate and the like), and organic amines (triethanolamine and the like). Among these sodium nitrite is the most preferred rust-preventive agent.

The rust-preventive agent need not be present when the workpiece is a highly rust-resistant material such as stainless steel or high-alloy steel.

When the rust-preventive agent is present and the workpiece is a material such as carbon steel, the rust-preventive agent is preferably used at from 1 to 10 weight % and more preferably at from 2 to 5 weight %, in each case based on the total weight of the alkali metal salt(s) of dimeric and/or trimeric acid(s) (A) plus any alkali metal salt of saturated fatty acid (B). At below 1 weight % a rust-preventive effect may not be generated in some cases, while exceeding 10 weight % accrues no additional improvement in the rust-preventive activity. When the workpiece is a highly rust-resistant material such as stainless steel or high-alloy steel, the amount of rust-preventive agent used is not critical, but additions, for example, no greater than 10 weight % can be used based on the preceding considerations.

A waterborne lubricant according to the present invention preferably contains a buffer (i.e, a component that reacts with any acidic or alkaline material that may be added to the lubricant in such a way as to resist changes from the initial pH value for the lubricant). This buffer is used in order to prevent the decline in the reactivity of the reactive soap that can be caused by variations in bath pH due to the admixture into the reactive soap bath of components from the pickling bath used as pretreatment or from the phosphate coating treatment bath. This buffer can be those buffers heretofore used in reactive soap treatment baths. Optimal buffers are exemplified by the alkali metal salts (sodium salt, potassium salt, and the like) of boric acid, wherein the preferred alkali metal borate is sodium tetraborate decahydrate (Japanese common name: hosha; English common name: borax).

The buffer is preferably used at from 1 to 10 weight % and particularly preferably at from 2 to 5 weight %, in each case referred to the total weight of the alkali metal salt(s) of dimeric and/or trimeric acid(s) (A) plus the alkali metal salt of saturated fatty acid (B). The use of less than 1 weight % can lead to a too weak pH buffering activity, while the use of more than 10 weight % does not lead to any additional improvements in the buffering activity.

The method for preparing the waterborne lubricant according to the present invention is not critical, and any method can be used that provides a waterborne lubricant that satisfies the various parameters and conditions described above. As an example, the subject waterborne lubricant can be prepared by first dissolving the alkali metal of salt(s) of dimeric acid(s) and/or trimeric acid(s) (A) and any optional alkali metal salt of saturated fatty acid (B) in water and thereafter adding the optional rust-preventive agent and/or buffer.

A waterborne lubricant according to the present invention can be used as the lubricant in the cold plastic working (e.g., tube drawing, wire drawing, forging) of stock, e.g., tube stock, wire stock, or bar stock, made of a metal such as carbon steel, stainless steel, or high-alloy steel (e.g., chromium/molybdenum steel). The subject waterborne lubricant can be used in particular as lubricant in the drawing of steel tube and pipe.

Since the waterborne lubricant according to the present invention is a type of reactive soap, application of the waterborne lubricant will as a general rule be preceded by execution of a conversion coating treatment, e.g., phosphate or oxalate. The relationship of this conversion coating treatment to application of the waterborne lubricant according to the present invention is not critical, and the conversion treatment can be run in the present case in the same manner as in the heretofore used technologies. After the conversion treatment, the workpiece should be rinsed with water and the waterborne lubricant according to the present invention can then be applied to the workpiece.

A waterborne lubricant according to the present invention can be applied to the conversion-treated metal stock by dipping. The treatment temperature is not critical, but temperatures of 70° C. to 90° C. are suitable. The treatment time is also not critical, but times from about 3 to 20 minutes are appropriate. While the post-treatment is not critical, the coating should be thoroughly dried, for example, using a drying oven at 100° C. to 140° C. A thorough drying is important, as residual moisture can prevent the development of the anticipated lubrication performance.

The optimal mass per unit area of dried film added-on from the waterborne lubricant as described above in a process according to this invention, a value often called "film weight" or "coating weight" for brevity, will vary as a function of the degree of working and other factors, but the film weight will generally be from 1 to 20 grams per square meter (hereinafter usually abbreviated as "$g/m^2$") and will preferably be from 2 to 10 $g/m^2$. An insufficient lubricating film weight results in an elevated friction coefficient and hence requires a higher-than-necessary working force.

The use of the waterborne lubricant according to the present invention in general provides a good lubricating performance even at lubricating film weights smaller than those for the use of prior-art reactive soaps. The subject lubricant also produces little dust during working operations.

The usual cold plastic working methods can be used to process metal stock carrying the coating formed by treatment as described above with a waterborne lubricant according to the present invention.

The invention is explained in greater detail, using reference examples of processes of preparing the salts of dimer(s) and trimer(s) required in compositions according to the invention, composition examples according to the invention, comparative composition examples, and "test" examples and comparison examples of drawing processes, some according to the invention, in the following part of this description.

Reference Example 1

1.5 kilogram (hereinafter usually abbreviated as "kg") of the dimer of oleic acid was heated to 70° C. and then combined with a 1.5 kg aqueous solution (at 30° C.) containing an amount of sodium hydroxide stoichiometrically just sufficient to neutralize all of the carboxyl groups of the dimeric acid. The mixture was stirred for 1 hour while maintaining a temperature of 90° C. in order to obtain a thorough mixing of the dimeric acid and sodium hydroxide. Cooling then yielded an aqueous solution of the disodium salt of the dimer of oleic acid.

Reference Example 2

An aqueous solution of the trisodium salt of the trimer of oleic acid was prepared as described in Reference Example 1, but in this case starting from 1.5 kg of the trimer acid of oleic acid instead of from the dimer acid of oleic acid and using an amount of sodium hydroxide just sufficient stoichiometrically to neutralize all of the carboxyl groups of the trimer of oleic acid.

EXAMPLE 1

A commercial sodium stearate was mixed into an aqueous solution containing an amount of the disodium salt of the dimer of oleic acid (this salt being hereinafter usually denoted briefly as "DSDAOA") that was prepared in Reference Example 1 so as to provide a value of 1/9 for the DSDAOA/sodium stearate weight ratio. The waterborne lubricant was then prepared by the addition of 0.3 weight % sodium nitrite and 0.3 weight % sodium tetraborate, both of these percentages being based on the weight of total DSDAOA+sodium stearate content. The content of the disodium dimer acid salt+sodium stearate in this waterborne lubricant was 10 weight %.

EXAMPLE 2

A waterborne lubricant was prepared as in Example 1, except for using a value of 2/8 for the DSDAOA/sodium stearate weight ratio. The content of the disodium dimer acid salt+sodium stearate in this waterborne lubricant was 10 weight %.

EXAMPLE 3

A waterborne lubricant was prepared as in Example 1, except for using a value of 3/7 for the DSDAOA/sodium stearate weight ratio. The content of the disodium dimer acid salt+sodium stearate in this waterborne lubricant was 10 weight %.

EXAMPLE 4

A commercial sodium stearate was mixed into an aqueous solution (500 g as trimer acid) of the trisodium salt of the trimer of oleic acid (this salt being hereinafter usually abbreviated as "TSTAOA") that was prepared in Reference Example 2 so as to provide a value of 1/9 for the trisodium trimer acid salt/sodium stearate weight ratio. The waterborne lubricant was then prepared by the addition of 0.3 weight % sodium nitrite and 0.3 weight % sodium tetraborate, both of these percentages being based on the weight of total TSTAOA+sodium stearate content. The content of the trisodium trimer acid salt+sodium stearate in this waterborne lubricant was 10 weight %.

EXAMPLE 5

A waterborne lubricant was prepared as in Example 4, but in the present case using a value of 2/8 for the trisodium trimer acid salt/sodium stearate weight ratio. The content of the trisodium trimer acid salt+sodium stearate in this waterborne lubricant was 10 weight %.

EXAMPLE 6

An aqueous solution of the TSTAOA prepared in Reference Example 2 was used directly as the waterborne lubricant. The content of the trisodium trimer acid salt in this waterborne lubricant was 10 weight %.

EXAMPLE 7

500 grams (hereinafter usually abbreviated as "g") of the trimer of nervonic acid was heated to 70° C. and then combined with a 500 g aqueous solution (at 30° C.) containing an amount of sodium hydroxide that was stoichiometrically just sufficient to neutralize all of the carboxyl groups of the trimeric acid. The mixture was stirred for 1 hour while maintaining a temperature of 90° C. in order to obtain a thorough mixing of the trimeric acid and sodium hydroxide. Cooling then yielded an aqueous solution of the trisodium salt of the trimer acid of nervonic acid (this salt being hereinafter usually abbreviated as "TSTANA"). The waterborne lubricant was prepared by mixing commercial sodium stearate into this aqueous solution so as to provide a value of 2/8 for the trisodium trimer acid salt/sodium stearate weight ratio. The content of the trisodium trimer acid salt+sodium stearate in this waterborne lubricant was 10 weight %.

Comparative Example 1

A waterborne lubricant was prepared by dissolving commercial sodium stearate in water and adding 0.3 weight % sodium nitrite and 0.3 weight % sodium tetraborate with mixing, both of these percentages being based on the weight of total TSTAOA+sodium stearate content. The sodium stearate content in this waterborne lubricant was 10 weight %.

Comparative Example 2

PALUBE® 235 concentrate, a commercial reactive soap concentrate from Nihon Parkerizing Company, Limited, was diluted with water to 7 weight % as the sodium salt of fatty acid.

Comparative Example 3

PALUBE® 4618 concentrate, a commercial reactive soap concentrate from Nihon Parkerizing Company, Limited, was diluted with water to 7 weight % as the sodium salt of fatty acid.

The compositions of the soaps in the preceding examples and in comparative to example 1 are summarized and reported in Table 1 below.

TABLE 1

SOAP COMPOSITION VALUES FOR THE EXAMPLES AND COMPARATIVE EXAMPLE 1

| Example or Comparative Example Number | Relative Parts by Weight in the Soap Component of: DSDAOA | TSTAOA | TSTANA | Sodium Stearate |
|---|---|---|---|---|
| Example 1 | 1 | 0 | 0 | 9 |
| Example 2 | 2 | 0 | 0 | 8 |
| Example 3 | 3 | 0 | 0 | 7 |
| Example 4 | 0 | 1 | 0 | 9 |
| Example 5 | 0 | 2 | 0 | 8 |
| Example 6 | 0 | 10 | 0 | 0 |
| Example 7 | 0 | 0 | 2 | 8 |
| Comparative Example 1 | 0 | 0 | 0 | 10 |

Test Example and Comparison Example Group 1

Conversion-treated steel tube stock was treated with waterborne lubricant as prepared in the examples and comparative examples, and the treated steel tube stock was then drawn. The lubricating performance and amount of dust generation were evaluated during this drawing operation.

(1) Specimen

Carbon steel tubing for machine structural applications (STKM13A(S) stock according to Japanese Industrial Standard, hereinafter usually abbreviated as "JIS", G-3445) was used. The lubricating film weight was evaluated on steel tubing with an outside diameter of 25.4 millimeters (hereinafter usually abbreviated as "mm"), wall thickness of 3 mm, and length of 100 mm. The performance was evaluated on steel tubing having the same outside diameter and wall thickness and a length of 2,000 mm.

(2) Treatment Procedure

The steel tubing was dipped in 15% hydrochloric acid for 10 minutes to remove the annealing scale and then thoroughly rinsed with water. After the water rinse the tubing was dipped for 10 minutes in a bath prepared by diluting PALBOND® 181× concentrate to 90 gIL with water. The bath temperature was 80° C. PALBOND® 181× concentrate is a zinc phosphate-type conversion coating agent from Nihon Parkerizing Co., Ltd. The phosphate treatment was followed by a thorough rinse with water, and the tubing was then dipped for 7 minutes in the particular waterborne lubricant of the example or comparative example, heated to 80° C. to produce the lubricating film.

(3) Measurement of the Lubricating Film Weights

The characteristic values of the lubricating film are defined as follows.

W1≡weight of film per unit area on the steel tubing after the lubricating film treatment, in $g/m^2$.

W2≡weight of film per unit area, in $g/m^2$, after the lubricating film-treated steel tubing referenced in the preceding item has been dipped for 30 minutes in distilled water at 90° C. to 95° C., then dried in an oven, and finally cooled to ambient temperature.

W3≡weight of film per unit area, in $g/m^2$, after the steel tubing subjected to the W2 treatment has been kept for 30 minutes in the vapors from a mixed solvent, consisting of isopropyl alcohol, n-heptane, and ethyl Cellosolve™ in a volume ratio to one another of 6:3:1, heated to 70° C. in a reservoir and then cooled to ambient temperature in a reflux column containing the steel tubing and the solvent vapors (until the vapors condense to liquid again).

W4≡weight of film per unit area, in $g/m^2$, after the steel tubing subjected to the W3 treatment has been dipped for 15 minutes in 5% (weight in grams/volume in deciliters) aqueous chromic acid solution at 80° C., rinsed with water, dried, and cooled.

The lubricating film weights were calculated from the following equations:

soluble soap weight (W1–W2)

insoluble metal soap weight (W2–W3)

zinc phosphate film weight (W3–W4)

(4) Lubrication Performance Testing and Evaluation

The lubricating film treated steel tubing was drawn using a chain-type draw bench (rated load=10 tons). The drawing rate was 17.8 meters/minute, a 20 mm cross-sectional diameter KD die and 16.0 mm cross sectional diameter MB plug were used, and drawing was run to yield an average cross-sectional area reduction ratio of about 46%.

The die load and plug load were measured during the drawing operation, and the lubricating performance was evaluated based on the size of these loads. Higher loads are indicative of a higher (less preferred) friction coefficient for the lubricating film during the working operation. In addition, after the drawing operation, the dust generated in front of the die was collected and weighed.

The results are reported in Table 2 below. These results confirmed that the waterborne lubricant according to the present invention gave a low drawing load and an excellent lubrication performance, even though it produced generally lower lubricating film weights than commercial reactive soaps and a waterborne lubricant whose soap component was only sodium stearate (comparative examples).

TABLE 2

LUBRICATING FILM WEIGHTS ON THE TREATED STEEL TUBING AND PERFORMANCE IN THE DRAWING OPERATION

| Example or Comparative Example Number | Coating Weight in g/m² of: Soluble Soap | Insoluble Soap | Phosphate Conversion Coating | Mass of Dust Accumulated, Grams | Kilograms of Force During Drawing on the: Die | Plug |
|---|---|---|---|---|---|---|
| Example 1 | 1.79 | 2.76 | 4.35 | 0.53 | 5455 | 417 |
| Example 2 | 1.53 | 2.23 | 4.75 | 0.44 | 5423 | 390 |
| Example 3 | 1.27 | 1.97 | 4.88 | 0.35 | 5412 | 385 |
| Example 4 | 1.98 | 3.10 | 4.53 | 0.60 | 5421 | 394 |
| Example 5 | 1.82 | 2.55 | 4.33 | 0.42 | 5320 | 377 |
| Example 6 | 1.84 | 2.23 | 4.73 | 0.38 | 5315 | 364 |
| Example 7 | 2.03 | 2.46 | 4.50 | 0.57 | 5301 | 387 |
| Comparative Example 1 | 1.95 | 3.22 | 4.36 | 0.82 | 5530 | 472 |
| Comparative Example 2 | 2.17 | 3.79 | 4.25 | 0.95 | 5480 | 465 |
| Comparative Example 3 | 2.01 | 2.53 | 4.23 | 0.87 | 5463 | 446 |

Test Example 2

In this example according to the invention, the service life of a waterborne lubricant according to the present invention was tested in an actual line operation.

The waterborne lubricant of Example 4 was substituted into the lubrication treatment line in a stainless steel pipe drawing operation. Specifically, the waterborne lubricant of Example 4 was substituted for a solution of PALUBE® 235 concentrate in a process that used FERRBOND® A (product of Nihon Parkerizing Company, Limited) for the base coating and PALUBE® 235 reactive soap concentrate (product of Nihon Parkerizing Company, Limited) for the lubricating film treatment. The service life was examined in the pipe drawing process by monitoring the time until the frequent occurrence of scratching during drawing. The bath was discarded and replaced in about 2 weeks in the case of the conventional lubricant, while the waterborne lubricant according to the present invention had an extended service life of 6 weeks, thus confirming this lubricant to be a long-bath life reactive soap. In addition, very little dust was produced at the work site.

Benefits of the Invention

Application of a waterborne lubricant according to the present invention in reactive soap lubrication treatment provides a lubricating performance that is as good as or better than that of prior-art products and does so at generally lower lubricating film weights. In addition, the waterborne lubricant according to the present invention has a much longer bath life and produces much less dust than prior-art products.

The invention claimed is:

1. A waterborne lubricant for cold plastic working of metals, said waterborne lubricant comprising water and:

(A) an amount of a component selected from the group consisting of an alkali metal salt of (1) at least one organic acid the molecules of which both (1.1) contain at least two carboxyl groups and (1.2) are vinylic addition dimers of carboxylic acids the molecules of which have from 10 to 24 carbon atoms and at least one double bond and (2) at least one organic acid the molecules of which both (2.1) contain at least three carboxyl groups and (2.2) are vinylic addition trimers of carboxylic acids the molecules of which have from 10 to 24 carbon atoms each and at least one double bond each.

2. A waterborne lubricant according to claim 1, also comprising:

(B) an amount of a component selected from the group consisting of an alkali metal salt of at least one saturated fatty acid the molecules of which have from 10 to 24 carbon atoms each, the amounts of components (A) and (B) being such that the amount of component (B) has a ratio to the amount, in the same waterborne lubricant, of component (A), measured in the same units as the amount of component (B), that is not greater than 19:1.0.

3. A waterborne lubricant according to claim 2, also comprising:

(C) an amount of rust-preventive agent that has a ratio from 0.010:1.0 to 0.10:1.0 to a sum of the amounts of components (A) and (B) in the same waterborne lubricant, the amounts in the ratio being measured in the same units; and (D) an amount of buffer that has a ratio from 0.010:1.0 to 0.10:1.0 to a sum of the amounts of components (A) and (B) in the same waterborne lubricant, the amounts in the ratio being measured in the same units.

4. A waterborne lubricant according to claim 3, in which component (A) is selected from salts of monounsaturated acids having from 16 to 20 carbon atoms per molecule and component (B) is selected from salts of acids having from 16 to 20 carbon atoms per molecule.

5. A waterborne lubricant according to claim 4, in which component (A), together with alkali metal salts of saturated fatty acids the molecules of which have from 10 to 24 carbon atoms that are present in said waterborne lubricant, constitutes from 5 to 40 weight % of the total waterborne lubricant.

6. A process of plastically working a metal substrate that has, on at least some of its surfaces that are in frictional contact during plastic working with other surfaces not part of the substrate, a dry lubricant coating comprising one or more metal salts of organic carboxylic acids having from 10 to 24 carbon atoms per molecule, wherein said dry lubricant coating is formed by a process comprising the following steps:

(I) providing the metal substrate with a dried conversion coating comprising cations of at least one divalent metal;

(II) contacting the dried conversion coating provided in step (I) with a waterborne lubricant according to claim 5 for a sufficient time to cause at least part of the divalent metal cations present in the dried conversion coating to form an adherent coating comprising divalent metal soaps with anions from the waterborne lubricant; and (III) discontinuing contact as established in step (II) and drying the substrate with the adherent coating formed in step (II) in place on the metal substrate.

7. A waterborne lubricant according to claim 3, in which component (A), together with alkali metal salts of saturated fatty acids the molecules of which have from 10 to 24 carbon atoms that are present in said waterborne lubricant, constitutes from 5 to 40 weight % of the total waterborne lubricant.

8. A process of plastically working a metal substrate that has, on at least some of its surfaces that are in frictional contact during plastic working with other surfaces not part of the substrate, a dry lubricant coating comprising one or more metal salts of organic carboxylic acids having from 10 to 24 carbon atoms per molecule, wherein said dry lubricant coating is formed by a process comprising the following steps:

(I) providing the metal substrate with a dried conversion coating comprising cations of at least one divalent metal;

(II) contacting the dried conversion coating provided in step (I) with a waterborne lubricant according to claim 7 for a sufficient time to cause at least part of the divalent metal cations present in the dried conversion coating to form an adherent coating comprising divalent metal soaps with anions from the waterborne lubricant; and (III) discontinuing contact as established in step (II) and drying the substrate with the adherent coating formed in step (II) in place on the metal substrate.

9. A waterborne lubricant according to claim 2, in which component (A) is selected from salts of monounsaturated acids having from 16 to 20 carbon atoms per molecule and component (B) is selected from salts of acids having from 16 to 20 carbon atoms per molecule.

10. A waterborne lubricant according to claim 9, in which component (A), together with alkali metal salts of saturated fatty acids the molecules of which have from 10 to 24 carbon atoms that are present in said waterborne lubricant, constitutes from 5 to 40 weight % of the total waterborne lubricant.

11. A process of plastically working a metal substrate that has, on at least some of its surfaces that are in frictional contact during plastic working with other surfaces not part of the substrate, a dry lubricant coating comprising one or more metal salts of organic carboxylic acids having from 10 to 24 carbon atoms per molecule, wherein said dry lubricant coating is formed by a process comprising the following steps:

(I) providing the metal substrate with a dried conversion coating comprising cations of at least one divalent metal;

(II) contacting the dried conversion coating provided in step (I) with a waterborne lubricant according to claim 10 for a sufficient time to cause at least part of the divalent metal cations present in the dried conversion coating to form an adherent coating comprising divalent metal soaps with anions from the waterborne lubricant; and (III) discontinuing contact as established in step (II) and drying the substrate with the adherent coating formed in step (II) in place on the metal substrate.

12. A waterborne lubricant according to claim 1 also comprising:

(C) an amount of rust-preventive agent that has a ratio from 0.010:1.0 to 0.10:1.0 to the amount of component (A) in the same waterborne lubricant, the amounts in the ratio being measured in the same units.

13. A waterborne lubricant according to claim 1, also comprising:

(D) an amount of buffer that has a ratio from 0.010:1.0 to 0.10:1.0 to the amount of component (A) in the same waterborne lubricant, the amounts in the ratio being measured in the same units.

14. A waterborne lubricant according to claim 13, in which component (A), together with alkali metal salts of saturated fatty acids the molecules of which have from 10 to 24 carbon atoms that are present in said waterborne lubricant, constitutes from 5 to 40 weight % of the total waterborne lubricant.

15. A process of plastically working a metal substrate that has, on at least some of its surfaces that are in frictional contact during plastic working with other surfaces not part of the substrate, a dry lubricant coating comprising one or more metal salts of organic carboxylic acids having from 10 to 24 carbon atoms per molecule, wherein said dry lubricant coating is formed by a process comprising the following steps:

(I) providing the metal substrate with a dried conversion coating comprising cations of at least one divalent metal;

(II) contacting the dried conversion coating provided in step (I) with a waterborne lubricant according to claim 14 for a sufficient time to cause at least part of the divalent metal cations present in the dried conversion coating to form an adherent coating comprising divalent metal soaps with anions from the waterborne lubricant; and (III) discontinuing contact as established in step (II) and drying the substrate with the adherent coating formed in step (II) in place on the metal substrate.

16. A waterborne lubricant according to claim 1, in which component (A) is selected from salts of monounsaturated acids having from 16 to 20 carbon atoms per molecule.

17. A waterborne lubricant according to claim 16, in which component (A), together with alkali metal salts of saturated fatty acids the molecules of which have from 10 to 24 carbon atoms that are present in said waterborne lubricant, constitutes from 5 to 40 weight % of the total waterborne lubricant.

18. A process of plastically working a metal substrate that has, on at least some of its surfaces that are in frictional contact during plastic working with other surfaces not part of the substrate, a dry lubricant coating comprising one or more metal salts of organic carboxylic acids having from 10 to 24 carbon atoms per molecule, wherein said dry lubricant coating is formed by a process comprising the following steps:

(I) providing the metal substrate with a dried conversion coating comprising cations of at least one divalent metal;

(II) contacting the dried conversion coating provided in step (I) with a waterborne lubricant according to claim 17 for a sufficient time to cause at least part of the divalent metal cations present in the dried conversion coating to form an adherent coating comprising divalent metal soaps with anions from the waterborne lubricant; and (III) discontinuing contact as established in step (II) and drying the substrate with the adherent coating formed in step (II) in place on the metal substrate.

19. A waterborne lubricant according to claim 1, in which component (A), together with alkali metal salts of saturated fatty acids the molecules of which have from 10 to 24 carbon atoms that are present in said waterborne lubricant, constitutes from 5 to 40 weight % of the total waterborne lubricant.

20. A process of plastically working a metal substrate that has, on at least some of its surfaces that are in frictional contact during plastic working with other surfaces not part of the substrate, a dry lubricant coating comprising one or more metal salts of organic carboxylic acids having from 10 to 24 carbon atoms per molecule, wherein said dry lubricant coating is formed by a process comprising the following steps:

(I) providing the metal substrate with a dried conversion coating comprising cations of at least one divalent metal;

(II) contacting the dried conversion coating provided in step (I) with a waterborne lubricant according to claim 19 or a sufficient time to cause at least part of the divalent metal cations present in the dried conversion coating to form an adherent coating comprising divalent metal soaps with anions from the waterborne lubricant; and (III) discontinuing contact as established in step (II) and drying the substrate with the adherent coating formed in step (II) in place on the metal substrate.

21. The waterborne lubricant according to claim 1, wherein said lubricant is a reactive soap, and can be dried to form a dry lubricant coating on said metal substrate.

22. A process of forming a dry lubricant coating on a metal substrate, said process comprising the steps of:

contacting the metal substrate with a waterborne lubricant according to claim 1 for sufficient time to form a lubricant coating on said metal substrate, and drying said metal substrate to form said dry lubricant coating, where said dry lubricant coating has a film weight sufficient to provide cold plastic working of said metal substrate.

23. The process of claim 22, wherein said metal substrate includes a dried conversion coating comprising cations of at least one divalent metal and said lubricant is a reactive soap, said process comprising contacting said metal substrate with said lubricant to react said reactive soap with said cations of said conversion coating.

24. The process of claim 23, wherein said waterborne lubricant includes said alkali metal salts of saturated fatty acids having 10 to 24 carbon atoms in an amount of 5 wt % to 40 wt % of the total waterborne lubricant.

* * * * *

UNITED STATES PATENT AND TRADEMARK OFFICE

CERTIFICATE OF CORRECTION

PATENT NO. : 6,318,139 B1
DATED : November 20, 2001
INVENTOR(S) : Ishikura et al.

It is certified that error appears in the above-identified patent and that said Letters Patent is hereby corrected as shown below:

Column 15,
Line 3, delete “or”, and insert therefor -- for --.

Signed and Sealed this

Thirtieth Day of December, 2003

JAMES E. ROGAN
*Director of the United States Patent and Trademark Office*